US006818371B2

(12) United States Patent
Iga et al.

(10) Patent No.: US 6,818,371 B2
(45) Date of Patent: Nov. 16, 2004

(54) ELECTROPHOTOGRAPHIC DEVELOPER, PROCESS FOR PRODUCING THE SAME, AND METHOD OF FORMING IMAGE

(75) Inventors: Takashi Iga, Kawasaki (JP); Kojiro Masuo, Kawasaki (JP); Kazuhiro Sato, Kawasaki (JP)

(73) Assignee: Zeon Corporation, Tokyo (JP)

( * ) Notice: Subject to any disclaimer, the term of this patent is extended or adjusted under 35 U.S.C. 154(b) by 0 days.

(21) Appl. No.: 10/181,948

(22) PCT Filed: Feb. 2, 2001

(86) PCT No.: PCT/JP01/00768

§ 371 (c)(1),
(2), (4) Date: Aug. 1, 2002

(87) PCT Pub. No.: WO01/57599

PCT Pub. Date: Aug. 9, 2001

(65) Prior Publication Data

US 2003/0022086 A1 Jan. 30, 2003

(30) Foreign Application Priority Data

Feb. 2, 2000 (JP) ..... 2000-024982

(51) Int. Cl.[7] ..... G03G 9/08

(52) U.S. Cl. ..... 430/108.7; 430/108.1; 430/111.41; 430/111.4

(58) Field of Search ..... 430/111.4, 111.41, 430/108.1, 108.7

(56) References Cited

U.S. PATENT DOCUMENTS 5,604,067 A 2/1997 Nagai et al.
5,827,632 A * 10/1998 Inaba et al. ..... 430/108.6
5,968,705 A 10/1999 Yamada et al.

FOREIGN PATENT DOCUMENTS

| | | | | |
|---|---|---|---|---|
| EP | 0 524 016 A1 | | 1/1993 | |
| JP | 60-254051 | | 12/1985 | |
| JP | 02-064652 | | 3/1990 | |
| JP | 03-203746 | | 9/1991 | |
| JP | 04-281464 | | 10/1992 | |
| JP | 05-019534 | | 1/1993 | |
| JP | 08-080370 | | 2/1996 | |
| JP | 08-248676 | | 9/1996 | |
| JP | 10-221886 | | 8/1998 | |
| JP | 11060703 A | * | 3/1999 | ..... C08G/63/12 |
| JP | 11-072949 | | 3/1999 | |
| JP | 11-119465 | | 4/1999 | |

OTHER PUBLICATIONS

English language machine translation of JP 11–060703 (Mar. 1999).*

* cited by examiner

*Primary Examiner*—Christopher Rodee
(74) *Attorney, Agent, or Firm*—Armstrong, Kratz, Quintos, Hanson & Brooks, LLP

(57) ABSTRACT

An electrophotographic developer comprising at least one element selected from the group consisting of boron and phosphorus in a content of 0.1 to 100 ppm, which the developer is excellent in flowability and shelf stability, does not give image defects such as occurrence of white stripes and attains almost constant image quality even when the ambient conditions including temperature and humidity fluctuate. A production process of a polymerized toner used in the developer, a production process of the developer, and an image forming process.

8 Claims, 1 Drawing Sheet

ELECTROPHOTOGRAPHIC DEVELOPER, PROCESS FOR PRODUCING THE SAME, AND METHOD OF FORMING IMAGE

TECHNICAL FIELD

The present invention relates to an electrophotographic developer and a production process thereof, and particularly to an electrophotographic developer which is excellent in flowability and shelf stability, does not give image defects such as occurrence of white stripes and attains almost constant image quality even when the ambient conditions including temperature and humidity fluctuate, and a production process thereof.

The present invention also relates a production process of a polymerized toner contained in the electrophotographic developer which exhibits such excellent properties or characteristics. The present invention further relates to an image forming process of the electrophotographic system making use of the electrophotographic developer.

BACKGROUND ART

In an image forming apparatus such as a copying machine or printer of the electrophotographic system, an electrostatic latent image formed on a photosensitive member is developed with a developer. The developer image formed on the photosensitive member is transferred to a transfer medium such as paper or OHP sheet as needed, and then fixed to the transfer medium by a method such as heating, pressing or use of solvent vapor.

As the developer, is used colored particles (toner) comprising a binder resin and a colorant. Developers are roughly divided into one-component developers with the surface of a toner coated with an external additive (flowability-imparting agent) such as silica and two-component developers composed of a toner and a carrier. The developers include magnetic developers making use of a magnetic toner comprising magnetic powder and non-magnetic developers making use of a toner comprising no magnetic powder. Non-magnetic one-component developers are recommended from the viewpoints of the miniaturization and weight saving of the image forming apparatus, and definition of images, etc.

There is yearly a strong demand for the improvement in the definition of images formed by the image forming apparatus of the electrophotographic system. As toners, toners (pulverized toners) obtained by a process (grinding process) comprising melting and mixing components such as a synthetic resin and a colorant and then grinding and classifying the resultant mixture to prepare colored particles have heretofore been used mainly. In recent years, attention has been attracted to toners (polymerized toners) composed of colored polymer particles obtained by a process in which a monomer composition comprising a polymerizable monomer and a colorant is subjected to suspension polymerization because they are easy to control their particle diameter, spherical and excellent in flowability and permit omitting a classification step.

Electrophotographic developers are required to have such characteristics or properties that they are excellent in flowability and shelf stability, do not give image defects such as occurrence of white stripes and attain almost constant image quality even when the ambient conditions including temperature and humidity fluctuate. However, it has been difficult to produce a toner and a developer satisfying these characteristics or properties, and various improved proposals have been made under the circumstances.

Japanese Patent Application Laid-Open No. 8-248676 has proposed an electrophotographic polymerized toner which is obtained by polymerizing a polymerizable monomer and has the relationship of $5\ \mu S/cm \leqq D_2 - D_1 \leqq 50\ \mu S/cm$, wherein $D_1$ is an electrical conductivity of water, and $D_2$ is an electrical conductivity of a filtrate obtained by dispersing the polymerized toner in the water in a proportion of 1 g per 20 ml of the water, fully stirring the dispersion to equilibrium and then filtering off the polymerized toner.

The publication shows that when this polymerized toner is mixed with a carrier composed of ferrite particles coated with a resin to use it as a two-component developer, a change in charge level is little even under different environments of low temperature and humidity and high temperature and humidity. In other words, this polymerized toner is charged by friction with magnetic iron powder.

When this polymerized toner is used as a non-magnetic one-component developer in an image forming apparatus of a system that the toner is charged by friction with a development roller or a development blade, however, the dependence of charge level on environment becomes high, and deterioration of image quality by environmental changes is observed. This toner is also insufficient in flowability and shelf stability.

Japanese Patent Application Laid-Open No. 11-72949 has proposed an electrophotographic developer comprising polymer particles (polymerized toner) for developer obtained by polymerizing a polymerizable monomer and an external additive attached to the surfaces of the particles, wherein the pH of a water extract obtained by a method (boiling extraction method) of dispersing the developer in ion-exchanged water having a pH of about 7 and boiling the dispersion is about 4 to 7.

This developer is greatly improved in deterioration of image quality by environmental changes and also improved in shelf stability and flowability. However, a further improvement is required to fully satisfy the requirement level for improvement in image quality.

DISCLOSURE OF THE INVENTION

It is an object of the present invention to provide to an electrophotographic developer which is excellent in flowability and shelf stability, does not give image defects such as occurrence of white stripes, can form high-quality images and attains almost constant image quality even by environmental changes of temperature, humidity and the like, and a production process thereof.

Another object of the present invention is to provide a production process of a polymerized toner suitable for use in such a developer.

A further object of the present invention is to provide an image forming process making use of the developer which exhibits such excellent properties or characteristics.

The present inventors have carried out an extensive investigation with a view toward achieving the above objects. As a result, the present inventors have conceived a developer comprising boron and/or phosphorus in a specified proportion. A polymerized toner comprising boron and/or phosphorus in a specified proportion is suitable for use as such a developer.

Such a polymerized toner can be produced by a process for producing a polymerized toner, comprising the step of subjecting a monomer composition comprising a polymerizable monomer and a colorant to suspension polymerization in an aqueous dispersion medium containing a dispersion stabilizer to form colored polymer particles, wherein at least one water-soluble compound selected from the group consisting of water-soluble boron compounds and water-soluble phosphorus compounds is caused to exist in the aqueous dispersion medium to conduct the suspension polymerization. The content of boron and/or phosphorus can be controlled within a preferred range by suitably performing post-treatment steps after the polymerization.

The polymerized toner obtained by such a production process can achieve a far excellent result when it is used as a one-component developer with an external additive added thereto, in particular, a non-magnetic one-component developer.

The present invention has been led to completion on the basis of these findings.

According to the present invention, there is thus provided an electrophotographic developer comprising at least one element selected from the group consisting of boron and phosphorus in a content of 0.1 to 100 ppm.

According to the present invention, there is also provided a process for producing a polymerized toner, comprising the step of subjecting a monomer composition comprising a polymerizable monomer and a colorant to suspension polymerization in an aqueous dispersion medium containing a dispersion stabilizer to form colored polymer particles, wherein at least one water-soluble compound selected from the group consisting of water-soluble boron compounds and water-soluble phosphorus compounds is caused to exist in the aqueous dispersion medium to conduct the suspension polymerization.

According to the present invention, there is further provided a process for producing an electrophotographic developer, which comprises recovering a polymerized toner composed of colored polymer particles in accordance with the production process described above and then adding an external additive to attach it to the surfaces of the colored polymer particles.

According to the present invention, there is still further provided an image forming process comprising the steps of developing an electrostatic latent image on a photosensitive member with an electrophotographic developer to form a developer image, transferring the developer image to a transfer medium and fixing the developer image on the transfer medium, wherein a developer comprising at least one element selected from the group consisting of boron and phosphorus in a content of 0.1 to 100 ppm is used as the electrophotographic developer.

BEST MODE FOR CARRYING OUT THE INVENTION

Figure 1:
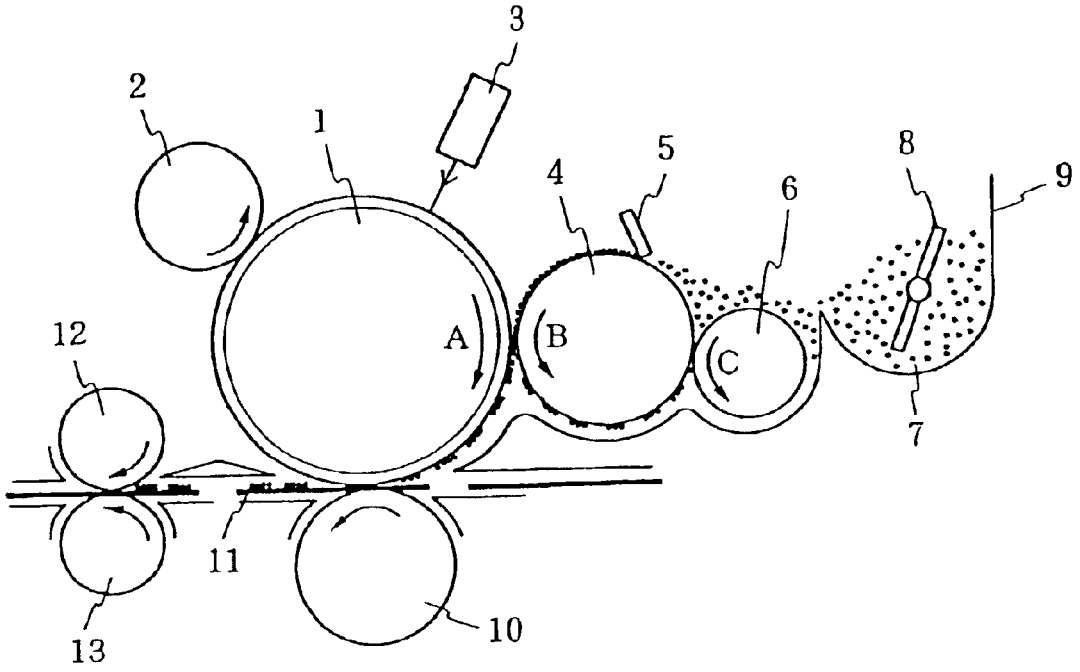
FIG. 1 is a cross-sectional view illustrating an exemplary image forming apparatus used in the image forming process according to the present invention therein.

Electrophotographic developers mainly include one-component developers composed of a colored polymer particles (toner) and an external additive and two-component developers composed of colored polymer particles and a carrier.

In the electrophotographic developer according to the present invention, the content of an element selected from the group consisting of boron and phosphorus is 0.1 to 100 ppm, preferably 0.2 to 50 ppm, more preferably 0.5 to 10 ppm. If the content of boron and/or phosphorus is too low, image defects such as white stripes are easy to occur. If the content of boron and/or phosphorus is too high, the image quality of an image formed with such a developer is deteriorated when temperature and/or humidity fluctuates. A preferred electrophotographic developer according to the present invention contains boron in a proportion of 0.1 to 100 ppm, preferably 0.2 to 50 ppm, more preferably 0.5 to 10 ppm.

The contents of boron and phosphorus are values measured in accordance with the following method. Namely, a developer sample (5 g) precisely weighed is placed in a 100-ml plastic container, ion-exchanged water (50 ml) is further added, and the container is shaken to disperse the developer. The container is then immersed in hot water of 90° C. to heat and shake it for 30 minutes. The dispersion is then filtered through a filter having a pore size of 0.4 $\mu$m, and the resultant filtrate is analyzed by using ion chromatography to determine boron and phosphorus, thereby finding the contents of boron and phosphorus in the developer.

According to this method, substantially the same values as the contents of boron and phosphorus when colored polymer particles are used as a sample to measure them. For example, a developer obtained by adding a small amount of an external additive such as silica to colored polymer particles shows substantially the same boron and phosphorus contents as in the case where the colored polymer particles used by themselves because the external additive contains neither boron nor phosphorous.

In the developer according to the present invention, the pH as measured in accordance with the boiling extraction method using ion-exchanged water is preferably 4 to 8, more preferably 4.5 to 7.5. If the pH value is too low or high, the dependence of charge level of such a developer on environment becomes high, and deterioration of image quality by environmental changes is caused.

The boiling extraction method using ion-exchanged water in the pH measurement is a method in which a developer sample (6 g) is dispersed in 100 g of ion-exchanged water (whose pH has been adjusted to about 7 by a cation-exchange treatment and an anion-exchange treatment), the resultant dispersion is boiled for 10 minutes, ion-exchanged water separately boiled for 10 minutes is added to the original volume before the boiling, the dispersion is cooled to room temperature, and the pH of a water extract is then measured by means of a pH meter.

In the electrophotographic developer according to the present invention, the electrical conductivity $\sigma 2$ of a developer dispersion obtained by the boiling extraction method using ion-exchanged water having an electrical conductivity of $\sigma 1$ is preferably 20 $\mu$S/cm or lower, more preferably 15 $\mu$S/cm or lower, and $(\sigma 2-\sigma 1)$ is preferably 10 $\mu$S/cm or smaller, more preferably 5 $\mu$S/cm or smaller. The electrical conductivity $\sigma 1$ of the ion-exchanged water used herein is generally 0 to 15 $\mu$S/cm.

If $\sigma 2$ is too high, or $(\sigma 2-\sigma 1)$ is too great, the dependence of charge level of such a developer on environment becomes high, and image quality is deteriorated by environmental changes such as changes of temperature and humidity.

The boiling extraction method using ion-exchanged water in the measurement of the electrical conductivity of the developer dispersion is a method in which a developer sample (6 g) is dispersed in 100 g of ion-exchanged water having an electrical conductivity of $\sigma 1$ to prepare a dispersion, the resultant dispersion is boiled for 10 minutes, ion-exchanged water separately boiled for 10 minutes is added to the original volume before the boiling, the dispersion is cooled to room temperature, and the electrical conductivity of the dispersion is then measured by means of a conductivity meter.

In the electrophotographic developer according to the present invention, it is desirable that (D2−D1) be preferably smaller than 5 μS/cm, more preferably not greater than 4 μS/cm, wherein D2 is an electrical conductivity of a filtrate obtained by dispersing 1 g of the developer in 20 ml of water having an electrical conductivity D1 to prepare a dispersion, fully stirring the dispersion to equilibrium and then filtering the dispersion. If the value of (D2−D1) is too great, the dependence of charge level of such a developer on environment becomes high, and image quality may tend to be deteriorated by environmental changes such as changes of temperature and humidity in some cases.

The electrophotographic developer according to the present invention may be a two-component developer composed of colored polymer particles and a carrier, but is preferably a one-component developer composed of colored polymer particles and an external additive attached to the surfaces of the particles.

The volume average particle diameter (dv) of the colored polymer particles making up the developer according to the present invention is generally 1 to 20 μm, preferably 1.5 to 15 μm, more preferably 1.5 to 8 μm. A ratio (dv/dp) of the volume average particle diameter (dv) to the number average particle diameter (dp) is generally at most 1.7, preferably at most 1.5, more preferably at most 1.3.

The colored polymer particles making up the developer according to the present invention have a ratio (rl/rs) of the length (rl) to the breadth (rs) within a range of generally 1 to 1.2, preferably 1 to 1.1. If the ratio is too high, the resolution of an image formed from such a developer may show a tendency to deteriorate in some cases. In addition, when the developer is contained in a developer container in an image forming apparatus, its durability shows a tendency to lower because friction between particles of the developer becomes greater, and so the external additive is separated from the colored polymer particles.

The colored polymer particles used in the present invention may be either particles composed of a single polymer or layered particles composed of a plurality of polymers. A typical example of the layered particles include particles having a core•shell structure (core•shell type colored polymer particles).

The particles having the core•shell structure can be produced by, for example, suspending a monomer composition (monomer composition for core) containing a polymerizable monomer and a colorant and optionally other components in an aqueous dispersion medium containing a dispersion stabilizer, polymerizing the monomer composition with a polymerization initiator to prepare colored polymer particles (A1) which will become core particles, adding a monomer for shell and a polymerization initiator to continue the polymerization, thereby forming a polymer layer, which will become a shell layer, on the surfaces of the core particles to provide core•shell type colored polymer particles (A2). In order to improve a balance between the high-temperature shelf stability and low-temperature fixing ability of the resulting developer, it is preferred that the glass transition temperature Tg of the polymer component forming the core be relatively low, and Tg of the polymer component forming the shell be relatively high.

The colored polymer particles are obtained by polymerizing a polymerizable monomer. As examples of the polymerizable monomer used for obtaining the colored polymer particles, may be mentioned monovinyl monomers. Specific examples of the monovinyl monomers include styrenic monomers such as styrene, vinyltoluene and α-methylstyrene; acrylic acid and methacrylic acid; derivatives of acrylic acid or methacrylic acid, such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide and methacrylamide; ethylenically unsaturated monoolefins such as ethylene, propylene and butylene; vinyl halides such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isopropenyl ketone; and nitrogen-containing vinyl compounds such as 2-vinylpyridine, 4-vinylpyridine and N-vinylpyrrolidone.

These monovinyl monomers may be used either singly or in any combination thereof. Among these monovinyl monomers, styrenic monomers and/or derivatives of acrylic acid or methacrylic acid are preferred, with styrene and/or alkyl (meth)acrylates being particularly preferred.

In the present invention, a crosslinkable monomer is preferably used in combination with the monovinyl monomer for the purpose of improving the shelf stability of the resulting developer. The crosslinkable monomer is a monomer having two or more polymerizable carbon—carbon unsaturated double bonds. Specific examples of the crosslinkable monomer include aromatic divinyl compounds such as divinylbenzene, divinylnaphthalene and derivatives thereof; di-ethylenically unsaturated carboxylic acid esters such as ethylene glycol dimethacrylate and diethylene glycol dimethacrylate; divinyl compounds such as N,N-divinylaniline and divinyl ether; and compounds having three or more vinyl groups. These crosslinkable monomers may be used either singly or in any combination thereof. The crosslinkable monomer is used in a proportion of generally 0.05 to 5 parts by weight, preferably 0.1 to 2 parts by weight per 100 parts by weight of the monovinyl monomer.

In the present invention, a macromonomer is preferably used in combination with the monovinyl monomer for the purpose of improving a balance between the shelf stability and fixing ability of the resulting developer. The macromonomer is a compound having a polymerizable vinyl functional group at its molecular chain terminal and is an oligomer or polymer having a number average molecular weight of generally 1,000 to 30,000. If a macromonomer having a too low number average molecular weight is used, the surface portions of the resulting colored polymer particles become too soft, and they tend to undergo blocking, whereby the shelf stability of the developer is deteriorated. If a macromonomer having a too high number average molecular weight is used on the other hand, the melt property of the resulting colored polymer particles is poor, resulting in a developer deteriorated in fixing ability and shelf stability.

Examples of the polymerizable vinyl functional group that the macromonomer has at its molecular chain terminal include an acryloyl group and a methacryloyl group, with the methacryloyl group being preferred from the viewpoint of easy copolymerization.

As specific examples of the macromonomer used in the present invention, may be mentioned polymers obtained by polymerizing styrene, styrene derivatives, methacrylic esters, acrylic esters, acrylonitrile and methacrylonitrile either singly or in combination of two or more monomers thereof: macromonomers having a polysiloxane skeleton; macromonomers disclosed in Japanese Patent Application Laid-Open No. 3-203746, pages 4 to 7; and macromonomers disclosed in U.S. Pat. No. 5,968,705, columns 5 to 20.

Among these macromonomers, hydrophilic macromonomers, particularly, macromonomers obtained by polymerizing methacrylic esters or acrylic esters either singly or in combination thereof are preferred.

The amount of the macromonomer used is generally 0.01 to 10 parts by weight, preferably 0.03 to 5 parts by weight, more preferably 0.05 to 1 part by weight per 100 parts by weight of the monovinyl monomer. If the amount of the macromonomer used is too little, it is difficult to sufficiently improve a balance between the shelf stability and fixing ability of the resulting developer. If the amount of the macromonomer used is extremely great, the fixing ability of the resulting developer is deteriorated.

The colored polymer particles contain a colorant and optionally other components such as a charge control agent, a parting agent, a softening agent and a dispersing agent for colorant.

As examples of the colorant, may be mentioned dyes and pigments such as carbon black, titanium white, Nigrosine Base, aniline blue, Chalcoil Blue, chrome yellow, ultramarine blue, Orient Oil Red, Phthalocyanine Blue and Malachite Green oxalate; and magnetic particles such as cobalt, nickel, diiron trioxide, triiron tetroxide, manganese iron oxide, zinc iron oxide and nickel iron oxide.

Examples of colorants for color developers include C.I. Direct Red 1 and 4, C.I. Acid Red 1, C.I. Basic Red 1, C.I. Mordant Red 30, C.I. Direct Blue 1 and 2, C.I. Acid Blue 9 and 15, C.I. Basic Blue 3 and 5, C.I. Mordant Blue 7, C.I. Direct Green 6, and C.I. Basic Green 4 and 6. Examples of pigments include chrome yellow, cadmium yellow, Mineral Fast Yellow, Navel Yellow, Naphthol Yellow S, Hansa Yellow G, Permanent Yellow NCG, Tartrazine Lake, chrome orange, molybdenum orange, Permanent Orange GTR, Pyrazolone Orange, Benzidine Orange G, cadmium red, Permanent Red 4R, Watchung Red Ca salt, eosine lake, Brilliant Carmine 3B, manganese violet, Fast Violet B, Methyl Violet Lake, ultramarine blue, cobalt blue, Alkali Blue Lake, Victoria Blue Lake, Phthalocyanine Blue, Fast Sky Blue, Indanthrene Blue BC, chrome green, chromium oxide, Pigment Green B, Malachite Green Lake and Final Yellow Green G.

Examples of magenta color pigments for full-color developers include C.I. Pigment Red 1 to 209, C.I. Pigment Violet 19 and C.I. Vat Red 1 to 35. Examples of magenta dyes include oil-soluble dyes such as C.I. Solvent Red 1 to 121, C.I. Disperse Red 9, C.I. Solvent Violet 8 to 27 and C.I. Disperse Violet 1; and basic dyes such as C.I. Basic Red 1 to 40 and C.I. Basic Violet 1 to 28.

Examples of cyan color pigments for full-color developers include C.I. Pigment Blue 2 to 17, C.I. Vat Blue 6, C.I. Acid Blue 45 and copper phthalocyanine dyes with 1 to 5 phthalimidomethyl groups added to a phthalocyanine skeleton.

Examples of yellow color pigments for full-color developers include C.I. Pigment Yellow 1 to 180 and C.I. Vat Yellow 1 to 20.

These colorants are used in a proportion of generally 0.1 to 20 parts by weight, preferably 1 to 10 parts by weight per 100 parts by weight of the polymerizable monomer (monovinyl monomer).

When the magnetic particles are used as a colorant, they are used in a proportion of generally 1 to 100 parts by weight, preferably 5 to 50 parts by weight per 100 parts by weight of the polymerizable monomer (monovinyl monomer) making up the polymer particles.

As examples of the parting agent, may be mentioned low molecular weight polyolefins such as low molecular weight polyethylene, low molecular weight polypropylene and low molecular weight polybutylene, and waxes. As the parting agent, may also be used a polyfunctional ester compound such as pentaerythritol tetramyristate, pentaerythritol tetralaurate, pentaerythritol tetrastearate, dipentaerythritol hexamyristate or glycerol triarachidate. When the polyfunctional ester compound is used, the softening point of the resulting colored polymer particles can be controlled. The parting agent is used in a proportion of generally 0.1 to 20 parts by weight, preferably 1 to 10 parts by weight per 100 parts by weight of the polymerizable monomer (monovinyl monomer).

As the charge control agent, may be used various kinds of charge control agents having positively charging ability or negatively charging ability. Examples of the charge control agents include metal complexes of organic compounds having a carboxyl group or a nitrogen-containing group, metallized dyes and nigrosine. Examples of commercially available products include Spiron Black TRH (product of Hodogaya Chemical Co., Ltd.), T-77 (product of Hodogaya Chemical Co., Ltd.), Bontron S-34 (product of Orient Chemical Industries Ltd.), Bontron E-84 (product of Orient Chemical Industries Ltd.), Bontron N-01 (product of Orient Chemical Industries Ltd.) and COPY BLUE-PR (product of Clariant). The charge control agent is used in a proportion of generally 0.01 to 10 parts by weight, preferably 0.03 to 5 parts by weight per 100 parts by weight of the binder resin or the polymerizable monomer (monovinyl monomer).

The polymerizable monomer is polymerized in accordance with a suspension polymerization process, an emulsion polymerization process, a dispersion polymerization process or the like. In the present invention, it is particularly preferred to conduct the polymerization by the suspension polymerization process.

The colored polymer particles can be prepared by a process (i.e., a grinding process) comprising melting and mixing a polymer obtained by polymerization of a polymerizable monomer with a colorant and the like, cooling and solidifying the molten mixture and then grinding the mixture. The colored polymer particles may also be obtained by a process (i.e., a polymerization process) comprising suspending a polymerizable monomer together with a colorant and the like and polymerizing the suspension. In the present invention, the colored polymer particles (polymerized toner) obtained by the polymerization process are preferably used. Particularly preferred are colored polymer particles obtained by subjecting a monomer composition comprising a polymerizable monomer and a colorant to suspension polymerization in an aqueous dispersion medium in which at least one water-soluble compound selected from the group consisting of boron compounds and phosphorus compounds has been dissolved.

In order to produce the colored polymer particles by the polymerization process, a monomer composition containing a polymerizable monomer and a colorant, and optionally other components is subjected to suspension polymerization. At this time, an aqueous dispersion medium, in which a water-soluble boron compound and/or a water-soluble phosphorus compound has dissolved, is used.

The water-soluble compound used in the present invention is a compound which at least contains any of boron and phosphorus and is soluble in water. Incidentally, the compound may be a compound decomposed in water after dissolved in water.

Examples of the water-soluble boron compound include boron trifluoride, boron trichloride, tetrafluoroboric acid, sodium tetrahydroborate, potassium tetrahydroborate, sodium tetraborate, sodium tetraborate decahydrate, sodium metaborate, sodium metaborate tetrahydrate, sodium peroxoborate tetrahydrate, boric acid, potassium metaborate and potassium tetraborate octahydrate.

Examples of the water-soluble phosphorus compound include phosphoric acid, phosphonic acid, phosphinic acid, metaphosphoric acid, diphosphoric acid, sodium phosphinate monohydrate, sodium phosphonate pentahydrate, sodium hydrogenphosphonate 2.5-hydrate, sodium phosphate dodecahydrate, disodium hydrogenphosphate, disodium hydrogenphosphate dodecahydrate, sodium dihydrogenphosphate monohydrate, sodium dihydrogenphosphate dihydrate, sodium hypophosphate decahydrate, sodium diphosphate decahydrate, disodium dihydrogendiphosphate, disodium dihydrogendiphosphate hexahydrate, sodium triphosphate, sodium cyclotetraphosphate, potassium phosphinate, potassium phosphonate, potassium hydrogenphosphonate, potassium phosphate, dipotassium hydrogenphosphate, potassium dihydrogenphosphate, potassium diphosphate trihydrate and potassium metaphosphate.

Among these water-soluble compounds, water-soluble boron compounds are preferred from the viewpoint of yielding good results, with tetraborates being particularly preferred. The water-soluble compound is preferably a water-soluble oxoacid salt because colored polymer particles having a sharp particle diameter distribution are easy to be provided. These water-soluble compounds are used in a proportion of generally 0.1 to 10 parts by weight, preferably 0.5 to 5 parts by weight per 100 parts by weight of the polymerizable monomer. When the water-soluble compound is used in this proportion, it is dissolved in an ordinary amount of the aqueous dispersion medium.

A dispersion stabilizer is generally added to the aqueous dispersion medium for the purpose of enhancing the stability of the suspension polymerization. As examples of the dispersion stabilizer, may be mentioned metallic compounds such as sulfates such as barium sulfate and calcium sulfate; carbonates such as barium carbonate, calcium carbonate and magnesium carbonate; phosphates such as calcium phosphate; and metal oxides such as aluminum oxide and titanium oxide; metal hydroxides such as aluminum hydroxide, magnesium hydroxide and ferric hydroxide; water-soluble polymers such as polyvinyl alcohol, methyl cellulose and gelatin; and surfactants such as anionic surfactants, nonionic surfactants and amphoteric surfactants. Among these, hardly water-soluble metallic compounds are preferred, with colloid of hardly water-soluble metallic compounds (preferably, hardly water-soluble metal hydroxides) being preferred because the particle diameter distribution of the resulting colored polymer particles can be narrowed, and the brightness or sharpness of an image formed from such a developer is enhanced.

The colloid of the hardly water-soluble metal hydroxide preferably used in the present invention preferably has $D_{50}$ (50% cumulative value of number particle diameter distribution) of at most 0.5 μm and $D_{90}$ (90% cumulative value of number particle diameter distribution) of at most 1 μm. If the particle diameter of the colloid is too great, the stability of the polymerization reaction system is easy to break, and the shelf stability of the resulting developer may be deteriorated in some cases.

The dispersion stabilizer is used in a proportion of generally 0.1 to 20 parts by weight, preferably 0.3 to 10 parts by weight per 100 parts by weight of the polymerizable monomer. If this proportion is too low, it may be difficult in some cases to achieve sufficient polymerization stability and dispersion stability, so that polymer aggregates are liable to form. If this proportion is too high, the particle diameter distribution of the resulting colored polymer particles is easy to widen due to increase in fine particles.

In the production process of a polymerized toner (colored polymer particles) according to the present invention, a monomer composition comprising a polymerizable monomer and a colorant is subjected to suspension polymerization in an aqueous dispersion medium containing a dispersion stabilizer to form the colored polymer particles. In this case, at least one water-soluble compound selected from the group consisting of water-soluble boron compounds and water-soluble phosphorus compounds is caused to exist in the aqueous dispersion medium to conduct the suspension polymerization.

The colored polymer particles may be colored polymer particles formed by the step of subjecting the monomer composition comprising a polymerizable monomer and a colorant to suspension polymerization, but are preferably colored polymer particles having a core-shell structure from the viewpoint of providing particles well balanced between fixing ability and shelf stability.

In the case where the core-shell type colored polymer particles are produced, preferred is a process comprising forming colored polymer particles (A1) by the step of subjecting a monomer mixture containing a polymerizable monomer and a colorant to suspension polymerization and then adding the step of polymerizing a polymerizable monomer, which is capable of forming a polymer having a glass transition temperature higher than that of the polymer component making up the colored polymer particles (A1), in the presence of the colored polymer particles (A1) to form a layer of the polymer having a higher glass transition temperature on the surfaces of the colored polymer particles (A1), thereby forming a polymerized toner composed of the core•shell type colored polymer particles (A2).

No particular limitation is imposed on the method of suspending the polymerizable monomer. For example, the polymerizable monomer, colorant, parting agent, charge control agent and other additives are added into a container for preparation of a dispersion, and the mixture is uniformly dispersed by means of a media type dispersing machine such as a bead mill to prepare a polymerizable monomer composition. The polymerizable monomer composition is then poured into the aqueous dispersion medium, and the resultant suspension is fully stirred to uniformly disperse droplets of the polymerizable monomer composition. A polymerization initiator, a molecular weight modifier and a crosslinking agent are then added and mixed, and the mixture is further stirred by means of a high-speed rotation shearing type stirrer until the droplet diameter of droplets of the monomer composition to be formed comes near to the intended particle diameter of the colored polymer particles.

More specifically, the formation of the droplets is continued until the volume average droplet diameter of the droplets of the monomer composition is generally 2 to 10 μm, preferably 2 to 9 μm, more preferably 3 to 8 μm. If the droplet diameter of the droplets is too great, the droplets during the polymerization become unstable, or colored polymer particles formed become too great, so that the resolution of an image formed with such a developer is deteriorated. A ratio of the volume average droplet diameter to the number average droplet diameter of the droplets is generally 1 to 3, preferably 1 to 2. If the droplet diameter distribution of the droplets is too broad, the fixing temperature of the resulting developer varies, so that inconveniences such as fogging and filming tend to occur. The droplets preferably have a droplet diameter distribution that at least 30 vol. %, preferably at least 60 vol. % of the droplets are present within a range of (the volume average droplet diameter+1 am). The aqueous dispersion medium containing the droplets of the monomer composition thus formed is transferred to a separate container (vessel for polymerization reaction) to subject the droplets to suspension polymerization at a temperature of generally 5 to 120° C., preferably 35 to 95° C.

The pH of the polymerization reaction mixture (dispersion medium) containing the colored polymer particles formed by the suspension polymerization is generally 8 to 12, preferably 8.5 to 11. If this pH is too low, the particle diameter distribution of the colored polymer particles tends to widen.

After completion of the suspension polymerization, the colored polymer particles formed are washed and dried by post-treatment steps to recover a polymerized toner (colored polymer particles) comprising at least one element selected from the group consisting of boron and phosphorus in a content of 0.1 to 100 ppm. Such colored polymer particles (including core•shell type colored polymer particles) are used to a prepare a developer, whereby a developer comprising at least one element selected from the group consisting of boron and phosphorus in a content of 0.1 to 100 ppm can be provided.

In the present invention, it is preferred that the following steps be arranged as post-treatment steps after the polymerization:

(1) a step of adjusting the pH of the polymerization reaction mixture containing the colored polymer particles formed to dissolve the dispersion stabilizer in the aqueous dispersion medium as needed;

(2) a step of subjecting the polymerization reaction mixture to solid-liquid separation to collect wet cake of the colored polymer particles; and (3) a step of dispersing the wet cake of the colored polymer particles in water to form a slurry again, filtering and dehydrating the resultant slurry through a filter cake layer formed from polymer particles for filtration and then washing the resultant cake with water.

When a hardly water-soluble metallic compound is used as a dispersion stabilizer, it is solubilized by adjusting the pH of the polymerization reaction mixture. The hardly water-soluble metallic compounds are divided into compounds solubilized by acidifying the pH of the polymerization reaction mixture with an acid such as hydrochloric acid or sulfuric acid and compounds solubilized by alkalifying the pH of the polymerization reaction mixture with an alkali such as sodium hydroxide according to the kinds thereof. Colloid of a hardly water-soluble metal hydroxide is preferred because the particle diameter distribution of the colored polymer particles formed is made sharp. When this colloid of the hardly water-soluble metal hydroxide is used as a dispersion stabilizer, it can be solubilized by adding an acid to the polymerization reaction mixture to acidify the pH thereof.

The polymerization reaction mixture is then subjected to solid-liquid separation to collect wet cake of the colored polymer particles. In this step, there is a process in which the polymerization reaction mixture is dehydrated by means of a continuous belt filter, and the resultant wet cake after the dehydration is washed by spraying washing water.

After the wet cake obtained by the solid-liquid separation is dispersed in water to form a slurry again, it is desirable that the resultant slurry be filtered and dehydrated through a filter cake layer formed from polymer particles for filtration, and the resultant cake be washed with water. In this step, it is preferred that centrifugal filtration and dehydration, and washing with water be performed by means of a centrifugal filter and dehydrater equipped with a filter cake layer.

As the filter cake layer, is preferably used a layer formed from polymer particles for filtration having a volume average particle diameter greater than that of the colored polymer particles formed. The volume average particle diameter of the polymer particles for filtration is desirably greater by generally 0.1 to 10 $\mu$m, preferably 1 to 5 $\mu$m. If the polymer particles for filtration are smaller than the colored polymer particles, the filter cake layer becomes the closest packing, and voids among particles are lessened, thereby lowering the dehydrating ability, so that the water content in the colored polymer particles recovered after dehydration and water washing becomes high, resulting in the provision of a developer high in dependence of charge level and the like on environment.

No particular limitation is imposed on the kind of a polymer forming the polymer particles for filtration. However, the polymer particles are preferably formed by the same polymer as that of the colored polymer particles for the purpose of preventing foreign matter from being mixed into the colored polymer particles as much as possible and contain the colorant, charge control agent, parting agent, etc. Specific examples of the polymer component of the polymer particles for filtration include copolymers of a styrenic monomer and a derivative of acrylic acid or methacrylic acid. Copolymers of styrene and an alkyl (meth)acrylate are particularly preferred.

In the production process according to the present invention, the slurry containing the colored polymer particles is filtered and dehydrated through the filter cake layer formed of the polymer particles for filtration, and the resulting cake is washed with water. The thickness of the filter cake layer is generally 2 to 20 mm, preferably 5 to 15 mm.

No particular limitation is imposed on the method of the filtration and dehydration. For example, centrifugal filtration, vacuum filtration and pressure filtration may be mentioned. Among these, the centrifugal filtration is preferred. As examples of the filter and dehydrater, may be mentioned a peeler centrifuge and a siphon peeler centrifuge.

In the centrifugal filtration, centrifugal force is preset to generally 400 to 3,000 G, preferably 800 to 2,000 G. It is preferred that centrifugal filtration and dehydration and washing be performed while feeding ion-exchanged water for washing upon filtration and dehydration.

The water content in the colored polymer particles after the dehydration is generally 5 to 30% by weight, preferably 8 to 25% by weight. If the water content in the colored polymer particles is too high, it takes a long time for the drying step. In addition, even when the concentration of impurities in water is low, the impurities are concentrated by drying when the water content is high, so that the dependence of the resulting developer on environment becomes high.

The water content was determined by putting a water-containing particle sample (2 g) on an aluminum pan, precisely weighing [$W_0$ (g)] the sample, leaving it to stand for 1 hour in an oven set to 105° C., cooling it and then precisely weighing [$W_1$ (g)] the sample to calculate the water content in accordance with the following equation:

$$\text{Water content}=[(W_0-W_1)/W_0]\times 100$$

When the colloid of the hardly water-soluble metal hydroxide is used as a dispersion stabilizer, it is preferred that the pH of the polymerization reaction mixture containing the colored polymer particles be adjusted to 6.5 or lower. A mineral acid such as sulfuric acid or hydrochloric acid; or an organic acid such as a carboxylic acid may be used for the pH adjustment. Among these acids, sulfuric acid is particularly preferred.

After such post-treatment steps, the colored polymer particles in a wet state are dried. In the colored polymer particles recovered in such a manner, the content of boron and/or phosphorus is controlled to 0.1 to 100 ppm (by weight).

In order to provide the colored polymer particles as a one-component developer, an external additive is added thereto. In the case of a two-component developer, colored polymer particles with the external additive attached thereto may also be used.

The external additive is an agent (flowability-improving agent) having a function of improving the flowability of the colored polymer particles. Besides, the external additive has such many functions that the charge property of the colored polymer particles is controlled, and abrasion property is imparted to the colored polymer particles to prevent the occurrence of a toner-filming phenomenon on a photosensitive member or the like. Such functions of the external additive are important from the viewpoint of properties of a developer in a one-component developer, particularly, a non-magnetic one-component developer.

Examples of the external additive used in the present invention include inorganic particles and organic resin particles. Examples of the inorganic particles include particles of silicon dioxide, aluminum oxide, titanium oxide, zinc oxide, tin oxide, barium titanate and strontium titanate. Examples of the organic resin particles include particles of methacrylic ester polymers, acrylic ester polymers, styrene-methacrylic ester copolymers and styrene-acrylic ester copolymers, and core-shell type polymer particles in which the core is composed of a methacrylic ester copolymer, and the shell is composed of a styrene polymer. Among these, the particles of the inorganic oxides are preferred, with silicon dioxide particles being particularly preferred. The surfaces of these particles may be subjected to a hydrophobicity-imparting treatment. Silicon dioxide particles subjected to the hydrophobicity-imparting treatment are particularly preferred. No particular limitation is imposed on the amount of the external additive used. However, it is generally 0.1 to 6 parts by weight, preferably 0.5 to 5 parts by weight, more preferably 1 to 4 parts by weight per 100 parts by weight of the colored polymer particles.

Two or more of the external additives may be used in combination. When the external additives are used in combination, it is preferable to combine two or more kinds of inorganic oxide particles or organic resin particles different in average particle diameter from each other.

More specifically, it is preferable to use particles (preferably, inorganic oxide particles) having an average particle diameter of 5 to 20 nm, preferably 7 to 18 nm and particles (preferably, inorganic oxide particles) having an average particle diameter of greater than 20 nm but not greater than 2 μm, preferably 30 nm to 1 μm in combination. The average particle diameter of the external additive means an average value of particle diameters of 100 particles selected and measured at random from among particles observed through a transmission electron microscope.

The amounts of the above two kinds of external additives used are generally 0.05 to 3 parts by weight, preferably 0.1 to 2 parts by weight per 100 parts by weight of the colored polymer particles for the particles having an average particle diameter of 5 to 20 nm and generally 0.05 to 3 parts by weight, preferably 0.1 to 2 parts by weight for the particles having an average particle diameter of greater than 20 nm, but not greater than 2 μm. A weight ratio of the particles having an average particle diameter of 5 to 20 nm to the particles having an average particle diameter of greater than 20 nm, but not greater than 2 μm is within a range of generally 1:5 to 5:1, preferably 3:10 to 10:3. Two or more external additives different in particle diameter can be used in combination, thereby well balancing functions such as flowability and abrasion property with each other.

In order to attach the external additives to the colored polymer particles, in general, the external additives and the colored polymer particles are charged into a mixer such as a Henschel mixer to mix them under stirring.

The image forming process according to the present invention is an image forming process comprising the steps of developing an electrostatic latent image on a photosensitive member with an electrophotographic developer to form a developer image, transferring the developer image to a transfer medium and fixing the developer image on the transfer medium, wherein a developer comprising at least one element selected from the group consisting of boron and phosphorus in a content of 0.1 to 100 ppm is used as the electrophotographic developer.

In other words, the process comprises the steps of developing an electrostatic latent image on a photosensitive member with the electrophotographic developer described above to form a developer image, transferring the developer image to a transfer medium and fixing the transferred developer image. The image forming process according to the present invention will be described in detail with reference to FIG. 1.

FIG. 1 is a cross-sectional view illustrating an exemplary image forming apparatus. In the image forming apparatus, a photosensitive drum 1 as a photosensitive member is installed rotatably in the direction of an arrow A. The photosensitive drum 1 has a structure that a photoconductive layer is provided around a peripheral surface of an electroconductive support drum. The photoconductive layer is formed of, for example, an organic photosensitive member, selenium photosensitive member, zinc oxide photosensitive member or amorphous silicon photosensitive member.

Around the photosensitive drum 1, a charging roll 2 as a charging means, a laser beam irradiating device 3 as a latent image forming means, a developing roll 4 as a developing means, a transfer roll 10 as a transfer means and a cleaning device (not illustrated) are arranged along the circumferential direction of the drum.

The charging roll 2 bears an action that the surface of the photosensitive drum 1 is evenly charged either positively or negatively. Voltage is applied to the charging roll 2, and the charging roll 2 is brought into contact with the surface of the photosensitive drum 1, thereby charging the surface of the photosensitive drum 1. The charging roller 2 may be replaced by a charging means by corona discharge, a charging belt or the like.

The laser beam irradiating device 3 bears an action that light corresponding to image signals is irradiated on the surface of the photosensitive drum 1 to expose the surface of the photosensitive drum 1 evenly charged to the light on the predetermined pattern, thereby forming an electrostatic latent image on the exposed portion of the drum (in the case of reversal development) or forming an electrostatic latent image on the unexposed portion of the drum (in the case of normal development). An example of other latent image forming means includes that composed of an LED array and an optical system.

The developing roll 4 bears an action that a developer is applied to the electrostatic latent image formed on the photosensitive drum 1 to develop the latent image. Bias voltage is applied between the developing roll 4 and the photosensitive drum 1 in such a manner that the developer is applied only to a light-exposed portion of the photosensitive drum 1 in reversal development, or only to a light-unexposed portion of the photosensitive drum 1 in normal development.

In a casing 9 for receiving the developer 7, a feed roll 6 is provided adjacently to the developing roll 4.

The developing roll 4 is arranged in close vicinity to the photosensitive drum 1 in such a manner that a part thereof comes into contact with the photosensitive drum 1, and is rotated in a direction B opposite to the rotating direction of the photosensitive drum 1. The feed roll 6 is rotated in contact with and in the same direction C as the developing roll 4 to supply the developer 7 to the outer periphery of the developing roll 4.

A blade 5 for developing roll as a layer thickness regulating means is arranged at a position between the contact point with the feed roll 6 and the contact point with the photosensitive drum 1 on the periphery of the developing roll 4.

The blade 5 is composed of conductive rubber or stainless steel, and voltage of |200 V| to |600 V| is generally applied to the blade to charge the toner. Therefore, the resistivity of the blade 5 is preferably $10^6$ Ωcm or lower.

The developer 7 is contained in the casing 9 of the image forming apparatus. Since the developer according to the present invention is excellent in flowability and shelf stability, the developer is prevented from aggregating during storage in the casing 9 or operation of the apparatus. In addition, image defects such as blurring or fogging are not caused.

The transfer roll 10 serves to transfer the developer image formed on the surface of the photosensitive drum 1 by the developing roll 4 to a transfer medium 11. Examples of the transfer medium 11 include paper and resin sheets such as OHP sheets. As transferring means, may be mentioned a corona discharge device and a transfer belt in addition to the transfer roll 10.

The developer image transferred to the transfer medium 11 is fixed on the transfer medium 11 by a fixing means. The fixing means is generally composed of a heating means and a press-bonding means. The developer transferred to the transfer medium is heated by the heating means to melt the developer, and the molten developer is pressed against the surface of the transfer medium by the press-bonding means to fix it thereto.

When a developer comprising the core•shell type colored polymer particles or colored polymer particles the softening point of which has been controlled, the developer is easily melted even when the heating temperature by the heating means is low, and is fixed to the transfer medium in a flattened state by slightly pressing it by the press-bonding means, so that high-speed printing or copying is feasible. Further, the developer image fixed to an OHP sheet is excellent in permeability through OHP.

The cleaning device serves to clean off the toner remaining on the surface of the photosensitive drum without transferring and is composed of, for example, a cleaning blade or the like. Incidentally, the cleaning device is not always required to install in the case where a system that cleaning is conducted at the same time as development by the developing roll 4 is adopted.

EXAMPLES

The present invention will hereinafter be described more specifically by the following Examples and Comparative Examples. All designations of "part" or "parts" and "%" as will be used in the following examples mean part or parts by weight and % by weight unless expressly noted. Physical properties or characteristics of colored polymer particles and developers were determined in accordance with the following respective methods.

(1) Content of Boron or Phosphorus:

A developer sample (5 g) precisely weighed was placed in a 100-ml plastic container, ion-exchanged water (50 ml) was further added, and the container was shaken to disperse the developer in the ion-exchanged water. The container was then immersed in hot water of 90° C. to heat and shake it for 30 minutes. The dispersion was then filtered through a filter having a pore size of 0.4 μm, and boron or phosphorus in the resultant filtrate was determined by ion chromatography to find the content of boron or phosphorus in the developer.

(2) pH:

A developer sample (6 g) was dispersed in 100 g of ion-exchanged water, and the resultant dispersion was heated and boiled for 10 minutes. In order to supply water evaporated by the boiling, ion-exchanged water separately boiled for 10 minutes was added to the original volume before the boiling. The dispersion was then cooled to room temperature to obtain a water extract of the developer. The pH of the water extract of the developer was measured by means of a pH meter. As the ion-exchanged water, was used water whose pH had been adjusted to about 7 by a cation-exchange treatment and an anion-exchange treatment.

(3) Electrical Conductivity σ2:

A developer sample (6 g) was dispersed in 100 g of ion-exchanged water having an electrical conductivity of σ1, and the resultant dispersion was boiled for 10 minutes. In order to supply water evaporated by the boiling, ion-exchanged water having an electrical conductivity of σ1 and separately boiled for 10 minutes was added to the original volume before the boiling. The dispersion was then cooled to room temperature to obtain a water extract of the developer. The electrical conductivity σ2 of the water extract of the developer was measured by means of a conductivity meter. Further, a value of (σ2−σ1) was calculated out from the electrical conductivity σ1 of the ion-exchanged water used and the electrical conductivity σ2 of the water extract of the developer.

(4) Volume Average Particle Diameter (dv) and Particle Diameter Distribution (dv/dp):

The volume average particle diameter (dv) and particle diameter distribution, i.e., a ratio (dv/dp) of the volume average particle diameter to the number average particle diameter (dp) of colored polymer particles were measured by means of a Multisizer (manufactured by Coulter Co.). The measurement by the Multisizer was conducted under the following conditions:

aperture diameter: 100 μm;

medium: Isothone II;

sample concentration: 10%; and number of particles measured: 100,000 particles.

(5) Water Content:

A water-containing particle sample (2 g) was put on an aluminum pan and precisely weighed to find the weight [$W_0$ (g)] of the sample. The aluminum pan, on which the water-containing particle sample had been placed, was left to stand for 1 hour in an oven set to 105° C. After cooling, the sample was precisely weighed to find the weight [$W_1$ (g)] of the sample to calculate out the water content by substituting these measured values into the following equation (I):

$$\text{Water content}=[(W_0-W_1)/W_0]\times 100 \quad \text{(I)}$$

(6) Flowability:

Three kinds of sieves (sieve openings: 150, 75 and 45 μm, respectively) were laid on top of another in that order from above, and a developer sample (4 g) to be measured was precisely weighed and put on the uppermost sieve. The three kinds of sieves were vibrated for 15 seconds by means of a powder measuring device ("POWDER TESTER", manufactured by Hosokawa Micron Corporation) under conditions of vibration intensity of 4. Thereafter, the weight of the developer captured on each sieve was measured and substituted into its corresponding equation shown below, thereby calculating out the respective numeric values of a, b and c. These values were substituted into the equation (II) to calculate out the value of flowability. The measurement was conducted 3 times on one sample to find an average value thereof.

Equations for Calculating:

$a$=[(weight ($g$) of the developer remaining on the sieve of 150 $\mu m$)/4 $g$]×100;

$b$=[(weight ($g$) of the developer remaining on the sieve of 75 $\mu m$)/4 $g$]×100×0.6;

$c$=[(weight ($g$) of the developer remaining on the sieve of 45 $\mu m$)/4 $g$]×100×0.2; and $$\text{Flowability } (\%)=100-(a+b+c) \quad \text{(II)}$$

(7) Fixing Ability:

A commercially available printer (printing speed: 24 paper sheets per minute) of a non-magnetic one-component development system was modified in such a manner that the temperature of a fixing roll can be varied. This modified printer was used to vary the temperature of the fixing roll, thereby determining the fixing rate at each temperature to find a relationship between the temperature and the fixing rate. The temperature of the fixing roll at which the fixing rate was 80% was evaluated as a fixing temperature.

The fixing rate was calculated from the ratio of image densities before and after a peeling operation using an adhesive tape, which was conducted against a black solid-printed area of a test paper sheet, on which printing had been made by the modified printer. More specifically, assuming that the image density before the peeling of the adhesive tape is $ID_{before}$, and the image density after the peeling of the adhesive tape is $ID_{after}$, the fixing rate can be calculated out from the following equation (III):

$$\text{Fixing rate } (\%)=(ID_{after}/ID_{before})\times 100 \quad \text{(III)}$$

In this test, the black solid-printed area means an area controlled in such a manner that the developer is caused to adhere to all dots (which are virtual dots controlling a control part of the printer) within this area.

The peeling operation of the adhesive tape is a series of operation that a pressure-sensitive adhesive tape (Scotch Mending Tape 810-3-18, product of Sumitomo 3M Limited) is applied to a measuring area of the test paper sheet to cause the tape to adhere to the sheet by pressing the tape under a fixed pressure, and the adhesive tape is then peeled at a fixed rate in a direction along the paper sheet. The image density was measured by means of a reflection image densitometer manufactured by McBeth Co.

(8) Shelf Stability:

Each developer sample was placed in a closed container to seal it, and the container was then sunk into a constant-temperature water bath controlled to 55° C. The container was taken out of the constant-temperature water bath after 24 hours had elapsed, and the developer contained in the container was transferred to a 42-mesh sieve. At this time, the developer was quietly taken out of the container so as not to destroy the aggregate structure of the developer in the container, and carefully transferred to the sieve. The sieve was vibrated for 30 seconds by means of the powder measuring device ("POWDER TESTER", manufactured by Hosokawa Micron Corporation) under conditions of vibration intensity of 4.5. The weight of the developer remaining on the sieve was then measured to regard it as the weight of the developer aggregated. A proportion (% by weight) of the weight of the aggregated developer to the weight of the whole developer was calculated out to use the value as an index to the shelf stability. The measurement was conducted 3 times on one sample to calculate the average value thereof.

(9) Dependence of Charge Level on Environment:

A printer (printing speed: 24 paper sheets per minute) of a non-magnetic one-component development system was charged with each developer sample under respective environments of 10° C. in temperature and 20% in relative humidity (L/L) and 30° C. in temperature and 80% in relative humidity (H/H), and left to stand for 24 hours. Thereafter, a print pattern of half tone was printed 5 times, and the developer on a developing roll was then sucked in a suction type charge level meter to measure a charge level per unit weight (μC/g) from the charge level and weight of the developer sucked at this time. The varied situations of the developer according to the environmental conditions were evaluated from the measured values of charge level under the respective environments.

(10) Environmental Dependence of Image Quality:

The above-described printer was used to conduct continuous printing from the beginning under respective environments of L/L (10° C./20% RH) and H/H (30° C./80% RH) to count the number of printed sheets that continuously retained an image density of 1.3 or higher as measured by a reflection densitometer (manufactured by McBeth Co.) and at an unprinted area, fog of 10% or lower as measured by a whiteness meter (manufactured by Nippon Denshoku K.K.), thereby evaluating a developer sample as to the environmental dependence of image quality in accordance with the following 3-rank standard:

A: the number of the printed sheets was 10,000 or more;

B: the number of the printed sheets was not less than 5,000, but less than 10,000; and C: the number of the printed sheets was less than 5,000.

(11) White Stripes:

The above-described printer was used to conduct continuous printing under environment of 23° C. in temperature and 50% in relative humidity (N/N). At the time the amount of toner contained was indicated as "low", a black solid image was printed. At this time, whether white stripes occurred or not was observed to evaluate as to the occurrence of white stripes in accordance with the following standard:

A: None of white stripes occurred;

B: White stripes slightly occurred; and

C: White stripes clearly occurred.

Example 1

(i) Preparation Step of Monomer Composition for Core:

One hundred parts of a monomer mixture (calculated Tg of the resulting copolymer=50° C.) composed of 78 parts of styrene and 22 parts of n-butyl acrylate, 7 parts of carbon black ("#25", trade name; product of Mitsubishi Kagaku Co., Ltd.), 1 part of a charge control agent ("Spiron Black TRH", trade name; product of Hodogaya Chemical Co., Ltd.), 0.3 parts of divinylbenzene. 0.8 parts of a polymethacrylic ester macromonomer ("AA6"; Tg=94° C.; product of Toagosei Chemical Industry Co., Ltd.), 10 parts of pentaerythritol tetrastearate and 4 parts of t-butyl peroxy-2-ethylhexanoate were stirred and mixed at 12,000 rpm in a homomixer (TK type, manufactured by Tokushu Kika Kogyo Co., Ltd.) capable of mixing with high shearing force, thereby uniformly dispersing them to prepare a monomer composition for core.

(ii) Preparation Step of Aqueous Dispersion of Monomer for Shell:

Ten parts of methyl methacrylate (calculated Tg of the resulting polymer=105° C.) and 100 parts of water were subjected to a finely dispersing treatment by an ultrasonic emulsifier, thereby obtaining an aqueous dispersion of a monomer for shell. The droplet diameter of droplets of the monomer for shell was found to be 1.6 $\mu$m in terms of $D_{90}$ (90% cumulative value of number particle diameter distribution) as determined by means of a microtrack particle diameter distribution measuring device by adding the droplets at a concentration of 3% to a 1% aqueous solution of sodium hexametaphosphate.

(iii) Preparation step of Aqueous Dispersion Medium:

An aqueous solution with 6.9 parts of sodium hydroxide (alkali metal hydroxide) dissolved in 50 parts of ion-exchanged water was gradually added to an aqueous solution with 9.8 parts of magnesium chloride (water-soluble polyvalent metallic salt) dissolved in 250 parts of ion-exchanged water under stirring to form colloid (colloid of hardly water-soluble metal hydroxide) of magnesium hydroxide, thereby preparing an aqueous dispersion medium containing the magnesium hydroxide colloid as a dispersion stabilizer. The particle diameter distribution of the magnesium hydroxide colloid was measured by means of a microtrack particle diameter distribution measuring device (manufactured by Nikkiso Co., Ltd.) and found to be 0.38 $\mu$m in terms of $D_{50}$ (50% cumulative value of number particle diameter distribution) and 0.82 $\mu$m in terms of $D_{90}$ (90% cumulative value of number particle diameter distribution). The measurement by means of the microtrack particle diameter distribution measuring device was performed under the following conditions:

measuring range: 0.12 to 704 $\mu$m;

measuring time: 30 seconds; and medium: ion-exchanged water.

(iv) Step of Forming Droplets of Monomer Composition for Core:

The magnesium hydroxide colloid-containing aqueous dispersion obtained in the step (iii) was used as an aqueous dispersion medium to pour the monomer composition for core prepared in the step (i) into the aqueous dispersion medium, and 1 part of sodium tetraborate decahydrate was further added thereto. The resultant mixture was stirred at 12,000 rpm under high shearing force by means of the TK type homomixer to form droplets of the monomer composition for core.

(v) Step of Suspension Polymerization:

The aqueous dispersion containing the droplets of the monomer composition for core prepared in the step (iv) was charged into a reactor equipped with an agitating blade to initiate a polymerization reaction at 90° C. At the time a conversion into a polymer reached almost 85%, the reactor was charged with 110 parts of the aqueous dispersion of the monomer for shell prepared in the step (ii) and 1 part of a 1% aqueous solution of potassium persulfate to continue the reaction for 5 hours. The reaction was stopped to obtain an aqueous dispersion of core-shell type colored polymer particles having a pH of 11.

(vi) Post-Treatment Step After Polymerization:

While stirring the aqueous dispersion of core-shell type colored polymer particles obtained in the step (v), sulfuric acid was added to adjust the pH of the aqueous dispersion to about 5.5, thereby conducting acid washing (at 25° C. for 10 minutes).

The aqueous dispersion was then dehydrated by means of a continuous belt filter ("Eagle Filter", trade name, manufactured by Sumitomo Heavy Industries, Ltd.). After the dehydration, washing water was sprayed on the residue to conduct water washing.

After the water washing, the resultant colored polymer particles were dispersed in water again to prepare an aqueous dispersion. The aqueous dispersion was then subjected to centrifugal filtration and dehydration by means of a siphon peeler centrifuge ("HZ40Si", manufactured by Mitsubishi Kakoki Kaisha Ltd.) under conditions of centrifugal force of 1,200 G, a filter cake layer having a layer thickness of 10 mm and a layer area of 0.25 $m^2$, ion-exchanged water for washing of 40 parts/hr, and a feed rate of the aqueous dispersion of 120 parts/hr. As a result, colored polymer particles having a water content of 15% were obtained.

In the filter cake layer, were used polymer particles for filtration having a volume average particle diameter of 7.8 $\mu$m obtained by subjecting 85 parts of styrene, 15 parts of n-butyl acrylate, 0.3 parts of divinylbenzene, 2 parts of a parting agent, 7 parts of carbon black ("Monaque 120", trade name, product of Cabot Co.) and 1 part of a charge control agent ("Spiron Black TRH", trade name; product of Hodogaya Chemical Co., Ltd.) to suspension polymerization.

The colored polymer particles having a water content of 15% were dried for 2 days by a dryer at 45° C. to recover core•shell type colored polymer particles (polymerized toner).

Even when the centrifugal filtration and dehydration using the siphon peeler centrifuge was continuously performed for at least 5 hours under the above-described conditions, the filter cake layer did not undergo clogging and exhibited good operating property.

(vii) Preparation Step of Developer:

To 100 parts of the core•shell type colored polymer particles (polymerized toner) obtained in the step (vi) were added 1 part of silica particles ("AEROSIL RX-200", trade name; product of Nippon Aerosil Co., Ltd.) having an average particle diameter of 12 nm subjected to a hydrophobicity-imparting treatment and 0.5 parts of silica ("AEROSIL RX-50", trade name: product of Nippon Aerosil Co., Ltd.) having an average particle diameter of 40 nm subjected to a hydrophobicity-imparting treatment, and they were mixed by means of a Henschel mixer to prepare a non-magnetic one-component developer with silica attached to the surfaces of the core-shell type colored polymer particles. The volume resistivity of the developer thus obtained was 11.5 (log Ω·cm).

The volume average particle diameter (dv) of the core•shell type colored polymer particles was 6.9 μm, the ratio (dv/dp) of the volume average particle diameter (dv) to the number average particle diameter (dp) was 1.21, and the ratio (rl/rs) of the length (rl) to the breadth (rs) was 1.1. The boron content in the developer was 1.7 ppm.

The evaluation of image with the developer revealed that under both environments of high temperature and high humidity (H/H), and low temperature and low humidity (L/L), extremely good-quality images good in color tone, high in image density and free of fog were obtained. The results are shown in Table 1.

Example 2

Core•shell type colored polymer particles (polymerized toner) were prepared and recovered in the same manner as in Example 1 except that the acid washing with sulfuric acid in "(vi) Post-treatment step after polymerization" in Example 1 was performed under conditions of pH 3.0. The water content of the colored polymer particles after the filtration was 14%. Even when the centrifugal filtration and dehydration was continuously performed for at least 5 hours, the filter cake layer did not undergo clogging and exhibited good operating property. The results are shown in Table 1.

Example 3

Core•shell type colored polymer particles (polymerized toner) were prepared and recovered in the same manner as in Example 1 except that the polymer particles for filtration having an average particle diameter of 7.8 μm used in the filter cake layer in "(vi) Post-treatment step after polymerization" in Example 1 was changed to polymer particles for filtration having an average particle diameter of 9.5 μm.

As the polymer particles for filtration, were used polymer particles obtained by subjecting 85 parts of styrene, 15 parts of n-butyl acrylate, 0.3 parts of divinylbenzene, 2 parts of a parting agent, 7 parts of carbon black ("Monaque 120", trade name, product of Cabot Co.) and 1 part of a charge control agent ("Spiron Black TRH", trade name; product of Hodogaya Chemical Co., Ltd.) to suspension polymerization.

The water content of the core•shell type colored polymer after the filtration was 14%. Even when the centrifugal filtration and dehydration was continuously performed for at least 5 hours, the filter cake layer did not undergo clogging and exhibited good operating property. The results are shown in Table 1.

Example 4

Core•shell type colored polymer particles (polymerized toner) were prepared and recovered in the same manner as in Example 1 except that 1 part of sodium metaphosphate tetrahydrate was used in place of 1 part of sodium tetraphosphate decahydrate in "(iv) Step of forming droplets of monomer composition for core" in Example 1, and the acid washing with sulfuric acid in "(vi) Post-treatment step after polymerization" was performed under conditions of pH 3.0. The results are shown in Table 1.

Comparative Example 1

Core•shell type colored polymer particles (polymerized toner) were prepared and recovered in the same manner as in Example 1 except that no sodium tetraphosphate decahydrate was used in "(iv) Step of forming droplets of monomer composition for core" in Example 1, and the acid washing with sulfuric acid in "(vi) Post-treatment step after polymerization" was performed under conditions of pH 3.0. The results are shown in Table 1.

Comparative Example 2

Core•shell type colored polymer particles (polymerized toner) were prepared and recovered in the same manner as in Example 1 except that polymer particles (volume average particle diameter=6.1 μm) having a volume average particle diameter smaller than the colored polymer particles were used as the polymer particles for filtration upon the centrifugal filtration and dehydration in "(vi) Post-treatment step after polymerization" in Example 1, and the acid washing with sulfuric acid in "(vi) Post-treatment step after polymerization" was performed under conditions of pH 3.0. Dehydration efficiency upon washing by the centrifugal filtration and dehydration was lowered, and the water content in the colored polymer particles after the filtration was as high as 28%. The results are shown in Table 1.

As the polymer particles for filtration, were used polymer particles obtained by subjecting 85 parts of styrene, 15 parts of n-butyl acrylate, 0.3 parts of divinylbenzene, 2 parts of a parting agent, 7 parts of carbon black ("Monaque 120", trade name, product of Cabot Co.) and 1 part of a charge control agent ("Spiron Black TRH", trade name; product of Hodogaya Chemical Co., Ltd.) to suspension polymerization.

TABLE 1

| | Ex. 1 | Ex. 2 | Ex. 3 | Ex. 4 | Comp. Ex. 1 | Comp. Ex. 2 |
|---|---|---|---|---|---|---|
| Water-soluble compound | Sodium tetraphosphate decahydrate | Sodium tetraphosphate decahydrate | Sodium tetraphosphate decahydrate | Sodium metaphosphate tetrahydrate | Not added | Sodium tetraphosphate decahydrate |
| pH | 6.2 | 6.1 | 6.0 | 5.9 | 6.0 | 3.9 |
| σ2 (μS/cm) | 9 | 10 | 9 | 9 | 16 | 74 |
| σ2–σ1 (μS/cm) | 2 | 3 | 2 | 2 | 5 | 70 |
| Content of boron or phosphorus (ppm) | 1.7 | 2.4 | 1.8 | 1.6 | 0 | 180 |
| Volume average particle diameter (μm) | 6.91 | 6.88 | 6.85 | 6.88 | 7.24 | 6.91 |
| dv/dp | 1.21 | 1.20 | 1.19 | 1.19 | 1.27 | 1.21 |
| Flowability (%) | 78 | 76 | 80 | 81 | 60 | 78 |
| Fixing temp. (° C.) | 140 | 140 | 140 | 140 | 140 | 140 |
| Shelf stability (%) | 2.3 | 2.5 | 2.2 | 1.9 | 5.2 | 2.4 |

TABLE 1-continued

| | Ex. 1 | Ex. 2 | Ex. 3 | Ex. 4 | Comp. Ex. 1 | Comp. Ex. 2 |
|---|---|---|---|---|---|---|
| Charge level ($\mu$C/g) | | | | | | |
| H/H | −28 | −27 | −28 | −30 | −18 | −10 |
| L/L | −29 | −29 | −29 | −32 | −23 | −25 |
| Image quality | | | | | | |
| H/H | A | A | A | A | B | C |
| L/L | A | A | A | A | B | C |
| White stripes | A | A | A | A | C | A |

Example 5

(A) Preparation Step of Monomer Composition for Core:

One hundred parts of a monomer mixture (calculated Tg of the resulting copolymer=55° C.) composed of 80.5 parts of styrene and 19.5 parts of n-butyl acrylate, 0.3 parts of a polymethacrylic ester macromonomer ("$AA_6$", trade name, Tg=94° C.; product of Toagosei Chemical Industry Co., Ltd.), 0.5 parts of divinylbenzene, 1.2 parts of t-dodecylmercaptan, 7 parts of carbon black ("#25B", trade name; product of Mitsubishi Kagaku Co., Ltd.) and 1 part of a charge control agent ("FCA-1001-NS", trade name; product of Fujikura Kasei Co., Ltd.) were subjected to wet grinding by means of a media type wet grinding machine to obtain a monomer composition for core.

(B) Preparation Step of Aqueous Dispersion Medium:

An aqueous solution with 6.2 parts of sodium hydroxide dissolved in 50 parts of ion-exchanged water was gradually added to an aqueous solution with 10.2 parts of magnesium chloride dissolved in 250 parts of ion-exchanged water under stirring to form colloid of magnesium hydroxide. The particle diameter distribution of the magnesium hydroxide colloid formed was measured by means of an SALD particle diameter distribution meter (manufactured by Shimadzu Corporation) and found to be 0.35 $\mu$m in terms of $D_{50}$ (50% cumulative value of number particle diameter distribution) and 0.62 $\mu$m in terms of $D_9$, (90% cumulative value of number particle diameter distribution).

(C) Preparation Step of Aqueous Dispersion of Monomer for Shell:

Two parts of methyl methacrylate (calculated Tg of the resulting polymer=105° C.) and 65 parts of water were subjected to a finely dispersing treatment by an ultrasonic emulsifier, thereby obtaining an aqueous dispersion of a monomer for shell. The droplet diameter of droplets of the monomer for shell was 1.6 $\mu$m in terms of $D_{50}$.

(D) Step of Forming Droplets of Monomer Composition for Core:

After the magnesium hydroxide colloid-containing aqueous dispersion (colloid content=4.5 parts) obtained in the step (B) was used as an aqueous dispersion medium to pour the polymerizable monomer composition for core into the aqueous dispersion medium, and the mixture was stirred until droplets became stable, 6 parts of t-butyl peroxyisobutyrate ("Perbutyl IB", trade name, product of Nippon Oil & Fats Co., Ltd.) were added, and 1 part of sodium phosphate dodecahydrate was further added. The resultant mixture was stirred for 30 minutes at 15,000 rpm under high shearing force by means of an Ebara Milder (trade name, manufactured by Ebara Corporation) to form droplets of the monomer composition for core.

(E) Step of Suspension Polymerization:

The aqueous dispersion of the monomer composition for core prepared in the step (D) was charged into a reactor equipped with an agitating blade to initiate a polymerization reaction at 85° C. At the time a conversion into a polymer reached almost 100%, the reactor was charged with a solution with 0.3 parts of a water-soluble initiator ["VA-086", trade name; product of Wako Pure Chemical Industries, Ltd.; 2,2'-azobis[2-methyl-N-(2-hydroxyethyl)-propionamide] dissolved in the aqueous dispersion of the monomer for shell prepared in the step (C). After continuing the polymerization for 4 hours, the reaction was stopped to obtain an aqueous dispersion of core•shell type colored polymer particles.

A proportion of coarse particles in the aqueous dispersion of core•shell type colored polymer particles obtained above was determined and found to be 0.28%.

(F) Post-Treatment Step After Polymerization:

While stirring the aqueous dispersion of core•shell type colored polymer particles obtained in the step (E), sulfuric acid was added to adjust the pH of the aqueous dispersion to about 4.5, thereby conducting acid washing (at 25° C. for 10 minutes).

The aqueous dispersion was then dehydrated by means of a continuous belt filter ("Eagle Filter", trade name, manufactured by Sumitomo Heavy Industries, Ltd.). After the dehydration, washing water was sprayed on the residue to conduct water washing.

After the water washing, the resultant colored polymer particles were dispersed in water again to prepare an aqueous dispersion. The aqueous dispersion was then subjected to centrifugal filtration and dehydration by means of a siphon peeler centrifuge ("HZ40Si", manufactured by Mitsubishi Kakoki Kaisha Ltd.) under conditions of centrifugal force of 1,200 G, a filter cake layer having a layer thickness of 10 mm and a layer area of 0.25 $m^2$, ion-exchanged water for washing of 40 parts/hr, and a feed rate of the aqueous dispersion of 120 parts/hr to isolate colored polymer particles having a water content of 15%. In the filter cake layer, were used polymer particles for filtration having a volume average particle diameter of 9.5 $\mu$m obtained by subjecting 85 parts of styrene, 15 parts of n-butyl acrylate, 0.3 parts of divinylbenzene, 2 parts of a parting agent, 7 parts of carbon black ("Monaque 120", trade name, product of Cabot Co.) and 1 part of a charge control agent ("Spiron Black TRH", trade name; product of Hodogaya Chemical Co., Ltd.) to suspension polymerization.

(G) Preparation Step of Developer:

To 100 parts of the core•shell type colored polymer particles (polymerized toner) obtained in the step (F) were added 1 part of silica particles ("AEROSIL RX-200", trade name; product of Nippon Aerosil Co., Ltd.) having an average particle diameter of 12 nm subjected to a hydrophobicity-imparting treatment and 0.5 parts of silica ("AEROSIL RX-50", trade name; product of Nippon Aerosil Co., Ltd.) having an average particle diameter of 40 nm subjected to a hydrophobicity-imparting treatment, and they were mixed by means of a Henschel mixer to prepare a non-magnetic one-component developer with silica attached to the surfaces of the core•shell type colored polymer particles. The volume resistivity of the developer thus obtained was 11.5 (log Ω·cm).

The volume average particle diameter (dv) of the core-shell type colored polymer particles was 7.99 μm, the ratio (dv/dp) of the volume average particle diameter (dv) to the number average particle diameter (dp) was 1.19, and the ratio (rl/rs) of the length (rl) to the breadth (rs) was 1.1. The phosphorus content in the developer was 2.0 ppm. Further, the pH, σ2 and (σ2−σ1) were 6.0, 11 μS/cm and 3 μS/cm, respectively.

The evaluation of image with the developer revealed that under both environments of high temperature and high humidity (H/H), and low temperature and low humidity (L/L), extremely good-quality images good in color tone, high in image density and free of fog were obtained.

INDUSTRIAL APPLICABILITY

According to the present invention, there can be provided developers which are excellent in shelf stability and flowability, do not very undergo changes in charge level under both environments of low temperature and low humidity, and high temperature and high humidity and attain almost constant image quality without being lowered. The developers according to the present invention can be suitably used in printers and copying machines of, for example, a non-magnetic one-component development system.

What is claimed is:

1. An electrophotographic developer comprising at least one element selected from the group consisting of boron and phosphorus in a content of 0.1 to 100 ppm, which is a developer comprising colored polymer particles and an external additive attached to the surfaces of the colored polymer particles, and wherein the electrical conductivity σ2 of a developer dispersion obtained by a boiling extracting method using ion-exchanged water having an electrical conductivity of σ1 is at most 20 μS/cm, and a difference (σ2−σ1) between the electrical conductivity σ2 of the developer dispersion and the electrical conductivity σ1 of the ion-exchanged water is at most 10 μS/cm.

2. The electrophotographic developer according to claim 1, wherein the developer is a one-component developer.

3. The electrophotographic developer according to claim 1, wherein the colored polymer particles are polymerized toner particles.

4. The electrophotographic developer according to claim 3, wherein the polymerized toner particles are core•shell type colored polymer particles that have a layer of a polymer on the surface of the colored polymer particles.

5. The electrophotographic developer according to claim 1, which is a one-component developer containing the external additive in a proportion of 0.1 to 6 parts by weight per 100 parts by weight of the colored polymer particles.

6. The electrophotographic developer according to claim 1, wherein the external additive is at least one particles selected from the group consisting of inorganic particles and organic resin particles.

7. The electrophotographic developer according to claim 6, wherein the inorganic particles are silicon dioxide particles subjected to a hydrophobicity-imparting treatment.

8. The electrophotographic developer according to claim 1 wherein the pH of a water extract of the developer obtained by a boiling extraction method using ion-exchanged water is 4 to 8.

* * * * *